US007048113B2

(12) United States Patent
Gomes

(10) Patent No.: US 7,048,113 B2
(45) Date of Patent: May 23, 2006

(54) MINIMALIST CAN WRAP

(75) Inventor: Jean-Manuel Gomes, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 10/401,477

(22) Filed: Mar. 28, 2003

(65) Prior Publication Data

US 2004/0188301 A1 Sep. 30, 2004

(51) Int. Cl.
*B65D 75/00* (2006.01)

(52) U.S. Cl. ..... 206/140; 206/434

(58) Field of Classification Search ..... 206/140, 206/175, 427, 434; 229/198.2
See application file for complete search history.

(56) References Cited

U.S. PATENT DOCUMENTS 3,381,881 A * 5/1968 Ganz et al. ..... 206/140
3,670,950 A * 6/1972 Rossi ..... 206/140
3,767,042 A * 10/1973 Ganz ..... 206/434
3,797,729 A * 3/1974 Holmes ..... 206/175
4,200,220 A * 4/1980 Ganz ..... 206/140
4,708,284 A * 11/1987 Sutherland et al. ..... 229/198.2
5,398,870 A * 3/1995 Bienaime ..... 229/198.2

* cited by examiner

*Primary Examiner*—Luan K. Bui
(74) *Attorney, Agent, or Firm*—Womble Carlyle Sandridge & Rice, PLLC

(57) ABSTRACT

A wrap-around can wrap which is secured together by primary and secondary locks with a single aperture securing both a primary and secondary lock, with each secondary lock being attached to a bottom flap of the carrier through a locking base. The locking base on each end of the carrier having a shoulder to secure the secondary lock, with the locking base for each secondary lock being reduced in length due to the presence of the locking shoulders. This carrier has open ends with the width of the carrier being such that cylindrical containers in the carrier project beyond the ends of the side panels of the carrier and are secured in place by a retaining flap that extends around a portion of the container that extends beyond the end of the side panel of the carrier from the top of the container to the adjacent side panel of the carrier, thereby permitting the width of the carrier to be significantly less than the width of a conventional open ended carrier.

24 Claims, 4 Drawing Sheets

MINIMALIST CAN WRAP

BACKGROUND OF THE INVENTION

1. Field of the Invention

The present invention relates generally to a minimalist can wrap with open ends where the cans are held from falling out by a retaining flap at the top and bottom of each side panel that holds the adjacent outside can in place. These retaining flaps are joined together by a tuck-in flap which is wedged between the side panel and the adjacent outside can and holds the top and bottom retaining flaps in proper position.

2. Prior Art

Can wraps with open ends have been used in the past. Can wraps with open ends which use various types of webbing to prevent the cans from falling out of the open ends have been used for some time.

When fabricating a can wrap from a paperboard blank, opposite sides of the blank are conventionally attached to each other by glue or by mechanical locks to form the bottom panel of the can wrap. In the case of the can wrap, flaps attached to the side of the blank typically are overlapped and engaged with one another by mechanical locks formed in the flaps to form the bottom panel of the can wrap. Since the bottom panel must maintain its integrity throughout the use of the can wrap, it is essential that the locking system be capable of supporting the weight of the cans and remain engaged during shipping and handling of the filled can wrap.

One approach to provide such a stable mechanical lock assembly utilizes primary and secondary locks. The primary locks connect the ends of the carton together via the flaps, while the secondary locks function to maintain the engaged flaps in place in order to provide a "backup" locking system to prevent the primary locks from separating.

For example U.S. Pat. No. 4,708,284 (Sutherland, et al.) issued on Nov. 24, 1987 discloses a locking arrangement including both a primary, and secondary male lock which utilizes a single female aperture for receiving both the primary and secondary male lock.

SUMMARY OF THE INVENTION

It is an object of the present invention to provide a can wrap with open ends utilizing a primary and secondary locking system which uses significantly less paperboard in constructing the can wrap than the present design. The present can wrap has open ends with the cans being held in place with retaining flaps at the top and bottom of each side panel that are held in place by an interconnecting tuck-in flap wedged between the side panel and the can. The present can wrap has a width that is at least equal to the sum of the diameters of the cans contained in each row. In order to save a significant amount of paperboard it is an object to find a way in which to decrease the width of the can wrap to less than the sum of the diameters of the cans in each row, but still hold the cans securely in place, if possible.

In order to save a significant amount of paperboard it is necessary to decrease the length of the blank of the can wrap since the length of the side panels and top panels are dictated by the size and number of cans contained. One way to reduce the length of the can wrap is in connection with the bottom flaps which are overlapped and held together by primary and secondary locking systems. Thus, it is a further object of this invention to reduce the length of the can wrap by reducing the length of the locking systems in the bottom flaps.

The objects of this invention have been achieved by providing a wrap-around carrier with open ends which contain the plurality of cylindrical containers in two rows. The wrap-around carrier has a top panel foldably connected to two side panels, one of which is connected to a first bottom flap and the other is connected to a second bottom flap. The first bottom flap has a plurality of primary male locks formed by slit cuts interconnected by a fold line and has a plurality of locking bases formed as an extension of the first bottom flap and has a secondary male lock formed as an extension of each locking base. The locking base adjacent to each end of the carrier has a locking shoulder which extends from the locking base of each secondary male lock adjacent the end of the carrier which aids in securing said locks in the locked position. The second bottom flap has a corresponding plurality of female openings, each of which has a primary locking ledge against which a primary male lock is secured and a secondary female locking ledge against which a secondary male lock is secured. The carrier has a tuck-in flap attached to each side panel at each end with the top of the tuck-in flap being foldably attached to a retaining flap which is also foldably attached to the top panel. A retaining flap is foldably attached to the bottom of each tuck-in flap and the bottom flap. The width of the carrier has been significantly reduced to a width less than the sum of the diameters of the containers in each row of containers so that all of the containers on each end of the carrier extend a significant distance beyond the end of the carrier when the carrier is loaded with containers. The containers are prevented from falling out of the carrier by the provision of each tuck-in flap being wedged between an end container and adjacent side panel so as to hold the retaining flaps against a top or bottom portion of the end container that projects beyond the end of the carrier.

An aperture may be provided between each retaining flap and the adjacent side panel to facilitate the folding and holding of said retaining flap securely against a portion of the adjacent container which projects beyond the end of the container.

The length of the carrier for this embodiment has been reduced by reducing the length of the base which is between each secondary male lock and the first bottom flap so that it is significantly less than the length for a conventional secondary male lock that extends beyond the end of the bottom flap of a carrier. The ability of the carrier to remain securely locked may be enhanced by providing locking shoulders between the locking base and the adjacent end of the carrier.

DETAILED DESCRIPTION OF THE PRIOR ART AND THE INVENTION

Figure 1:
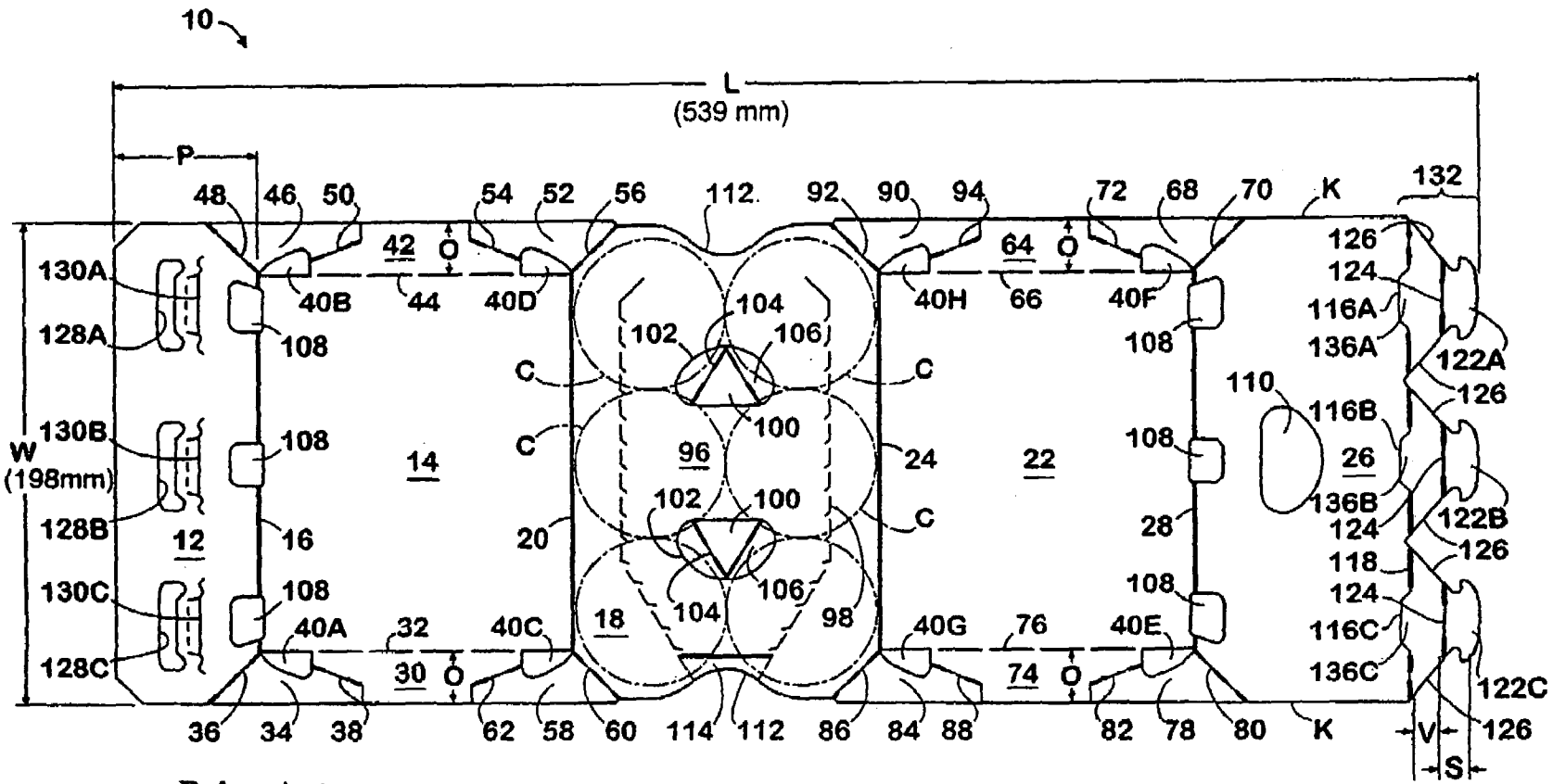
FIG 1 Prior Art
FIG. 1 is a plan view of a blank for a six can wrap of the prior art.

The prior art can wrap and the invented minimalist can wrap are intended primary for use for cans of the types used to contain soft drinks, beer, and the like. A typical example of a can that can be wrapped with the prior art carton and with the invented minimalist carton contains 354 milliliters of a drink. This size of can will be used as a reference throughout this description, but it should be realized that the minimalist can wrap of this invention is equally applicable to other sizes of cans as well. The blank for forming the prior art wrap is illustrated in FIG. 1. The can wrap made from the blank 10 is designed to contain six beverage cans C of 354 milliliters capacity each in two rows of three cans each. The blank 10 is formed from a foldable sheet material, such as paperboard. The blank 10 has a bottom flap 12 which is foldably connected to side panel 14 by fold line 16 and in turn foldably connected to top panel 18 by fold line 20, and in turn connected to side panel 22 by fold line 24. Side panel 22 is connected to bottom flap 26 by fold line 28. Side panel 14 is foldably connected to tuck-in flaps 30 and 42 by fold lines 32 and 44 respectively. Retaining flap 34 is foldably connected to bottom flap 12 by fold line 36 and foldably connected to tuck-in flap 30 by fold line 38. Retaining flap 46 is foldably connected to bottom flap 12 by fold line 48 and to tuck-in flap 42 by fold line 50. Retaining flap 52 is connected to tuck-in flap 42 by fold line 54 and to top panel 18 by fold line 56. In a similar fashion retaining flap 58 is foldably connected to top panel 18 by fold line 60 and foldably connected to tuck-in flap 30 by fold line 62.

On the other side of the can wrap, tuck-in flap 64 is foldably connected to side panel 22 by fold line 66. Retaining flap 68 is foldably connected to bottom flap 26 by fold line 70 and to tuck-in flap 64 by fold line 72. Tuck-in flap 74 is foldably connected to side panel 22 by fold line 76. Retaining flap 78 is foldably connected to bottom flap 26 by fold line 80 and to tuck-in flap 74 by fold line 82. Tuck-in flap 74 is foldably connected to a retaining flap 84 by fold line 88. Retaining flap 84 is foldably connected to top panel 18 by fold line 86. Retaining flap 90 is foldably connected to top panel 18 by fold line 92 and to tuck-in flap 64 by fold line 94.

In order to facilitate the folding of the tuck-in flaps and retaining flaps, stress relieving apertures 40A–H are included at each corner of the side panels 14 and 22.

This can wrap may have a dispenser in the top panel 18 that is defined by tear line 98, which when torn permits the removal of most of dispenser flap 96. The dispenser flap 96 may have a fold line 114 about which the dispenser flap 96 can be folded to aid in maintaining the integrity of the can wrap.

For carrying this can wrap, finger flaps 100 may be provided which are partially separated from dispenser flap 96 by cut line 102. The finger flap 100 is partially removed from the plane of the top panel 18 by either being pushed inwardly or pulled outwardly to form a finger aperture 106 for easy carrying of this can wrap. Finger flaps 100 may have fold lines 104 to facilitate moving the finger flap 100 from the plane of the top panel 18.

This can wrap may have heel apertures 108 through which a portion of the bottom chime (not shown) of can C projects which assists in holding the can C in proper position in the can wrap. The can wrap may have an aperture 110 in bottom flap 26 for reading information on the bottom of a can C. The ends of top panel 18 may have a top arcuate indentations 112 which are located between the two rows of cans C.

This prior art can wrap has a conventional locking system including both a primary locking system and a secondary locking system. The primary locking system is a locking arrangement between primary male locks 116A–C in male locking panel 132, and primary female openings 128A–C. The primary male locks 116A–C are hooked over the ledges of the primary female openings 128A–C in bottom flap 12. The primary male locks 116A–C are separated by fold lines 118 which also serve to delineate the male locking panel 132. During the locking of the wrap it is important to tighten the wrap tightly about the cans. The primary locks connect the ends of the wrap together by engaging the primary female openings.

The secondary locking system consists of secondary male locks 122A–C in male locking panel 132 formed as an extension of the male locking panel and secondary female openings 130A–C formed in bottom flap 12. The secondary male locks may have fold lines 124 to facilitate easy locking of the secondary male locks. The secondary male locks 122A–C are formed at the end of converging base lines 126 extending from the fold lines 118 between the bottom flap 26 and male locking panel 132.

This prior art can wrap may be formed from the blank of FIG. 1 by moving the top panel 18 of the blank 10 over a group of cans C. Tuck-in flaps 30, 42, 64 and 74 are folded inwardly as side panels 14 and 22 are moved downwardly so that the tuck-in flaps are held against the inside of side panels 14 and 22 by the adjoining cans. This pulls retaining flaps 34, 46, 52, 58, 68, 78, 84 and 90 tightly against the tops and bottoms of each adjacent can to the retaining flaps preventing the cans from falling out of the can wrap. Fingers on the wrap machine push in the tuck-in flaps 30, 42, 64, and 74. The stress relieving apertures 40A–G facilitate moving these tuck-in flaps and retaining flaps inwardly. Side panels 14 and 22 are pushed downwardly and inwardly and bottom flap 12 is pushed upwardly against the bottoms of the cans. Compression fingers can be inserted through the heel apertures 108 to tighten the wrap. The secondary male locks 122A–C are pushed inwardly into secondary female openings 130A–C. The primary male locks 116A–C are pushed inwardly into primary female openings 128A–C. The secondary lock system serves the function of insuring that the primary lock system does not come undone.

MINIMALIST CAN WRAP

The minimalist can wrap is also intended primary for the use of wrapping cans that contain soft drinks, beer and the like. For illustration and comparison purposes with the prior art carrier described supra, the can wrap will be described in relation to the same 354 milliliter can. It should be noted that the minimalist can wrap is also applicable to other sizes of cans, or other types of cylindrical containers.

Figure 2:
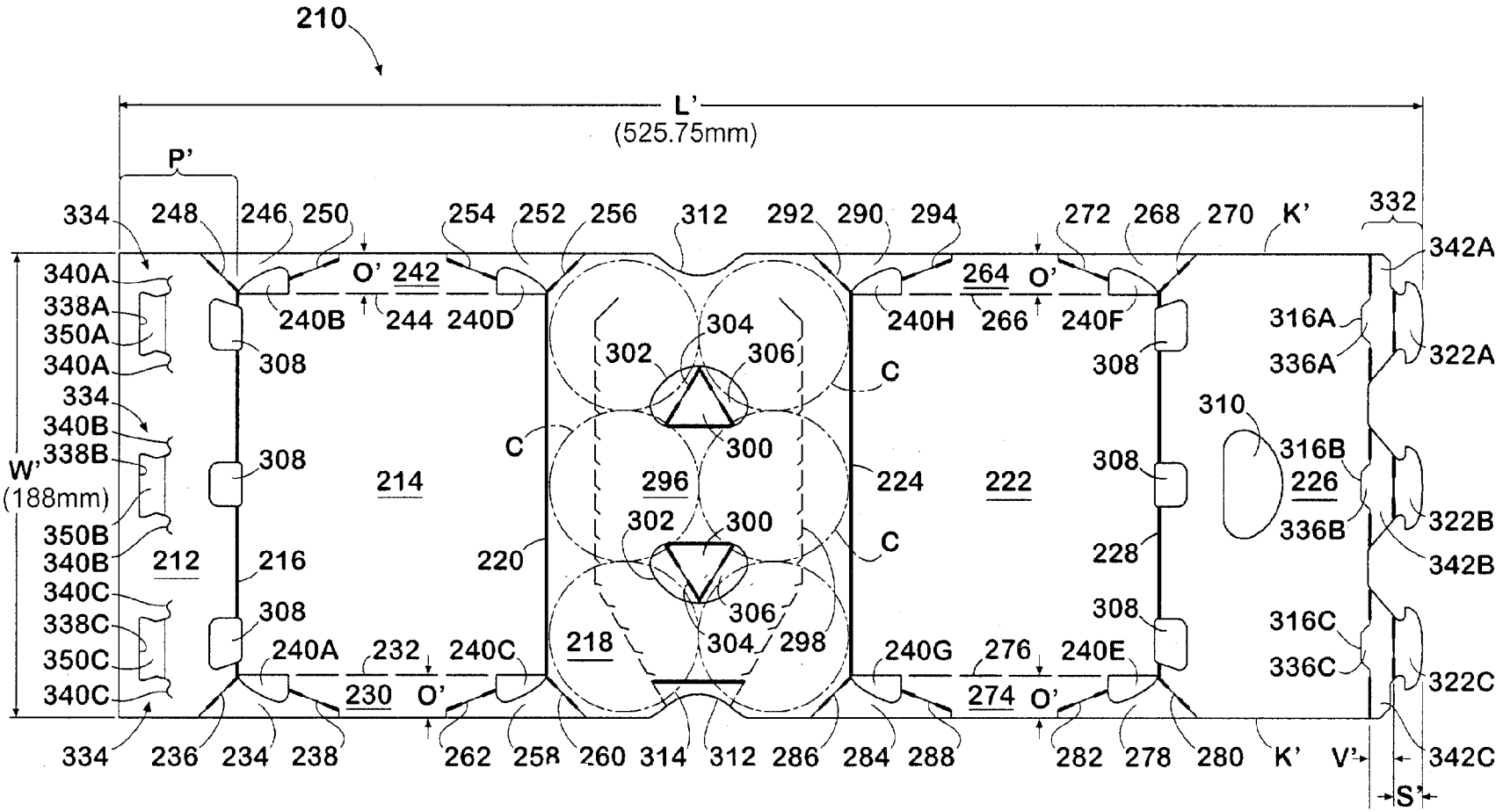
FIG. 2 is a plan view of a blank for a minimalist six can wrap of this invention.
Figure 3:
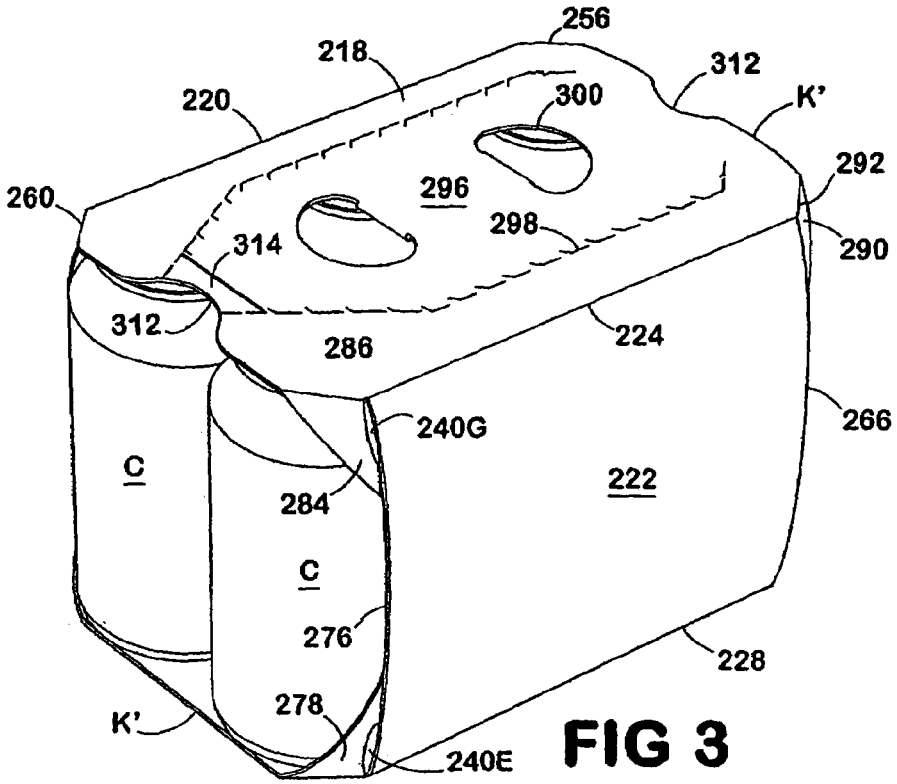
FIG. 3 is a perspective view of a minimalist six can wrap made from the blank of FIG. 2 and filled with cans.

The blank for forming the wrap of this minimalist can wrap of this invention is illustrated in FIG. 2. The blank 210 is designed to contain six beverage cans C of 354milliliters capacity each in two rows of three cans each. The blank is formed from a foldable sheet material, such as paperboard. The blank 210 has a bottom flap 212 which is foldably connected to side panel 214 by fold line 216 and in turn foldably connected to top panel 218 by fold line 220, and in turn connected to side panel 222 by fold line 224. Side panel 222 is connected to bottom flap 226 by fold line 228. Side panel 214 is foldably connected to tuck-in flaps 230 and 242 by fold lines 232 and 244 respectively. Retaining flap 234 is foldably connected to bottom flap 212 by fold line 236 and foldably connected to tuck-in flap 230 by fold line 238.

Retaining flap 246 is foldably connected to bottom flap 212 by fold line 248 and to tuck-in flap 242 by fold line 250. Retaining flap 252 is connected to tuck-in flap 242 by fold line 254 and to top panel 218 by fold line 256. In a similar fashion retaining flap 258 is foldably connected to top panel 218 by fold line 260 and foldably connected to tuck-in flap 230 by fold line 262.

On the other side of the can wrap, tuck-in flap 264 is foldably connected to side panel 222 by fold line 266. Retaining flap 268 is foldably connected to bottom flap 226 by fold line 270 and to tuck-in flap 264 by fold line 272. Tuck-in flap 274 is foldably connected to side panel 222 by fold line 276. Retaining flap 278 is foldably connected to bottom flap 226 by fold line 280 and to tuck-in flap 274 by fold line 282. Tuck-in flap 274 is foldably connected to a retaining flap 284 by fold line 288 and is foldably connected to top panel 218 by fold line 286. Retaining flap 290 is foldably connected to top panel 218 by fold line 292 and to tuck-in flap 264 by fold line 294.

In order to facilitate the folding of the tuck-in flaps and retaining flaps and holding the retaining flaps in position when the wrap is loaded with containers, stress relieving apertures 240A–H are included at each corner of the side panels 214 and 222.

This can wrap may have a dispenser in the top panel 218 that is defined by tear line 298, which when torn results in the removal of most of dispenser flap 296. The dispenser flap 296 may have a fold line 314 about which the dispenser flap 296 can be folded to aid in maintaining the integrity of the can wrap.

For carrying this can wrap, finger flaps 300 may be provided which are partially separated from dispenser flap 296 by cut line 302. The finger flap 300 is partially removed from the plane of the top panel 218 by either being pushed inwardly or pulled outwardly to form a finger aperture 306 for easy carrying of this can wrap. Finger flaps 300 may have crease lines 304 to facilitate moving the finger flap 300 from the plane of the top panel 218.

This can wrap may have heel apertures 308 through which a portion of the bottom chime (not shown) of can C projects which assists in holding the can C in proper position in the can wrap. The can wrap may have aperture 310 in bottom flap 226 for reading information on the bottom of a can C. The top panel 218 may have top arcuate indentations 312 which are located between the two rows of cans C.

The minimalist can wrap of this invention has a minimalist locking system. The locking system on this embodiment includes both a primary locking system and a secondary locking system. As shown in FIG. 2 the locking system has primary male locks 316A–C in male locking panel 332 and secondary male locks 322A–C which are formed as an extension of bottom flap 226.

The minimalist female locking system consists of a single aperture in the female openings 350A–C for each locking pair of both primary and secondary male locks. The female openings 350A–C are formed in the female locking panel 334. Each female opening 350A–C has a primary female locking ledge 338A–C respectively and a secondary female locking ledge 340A–C respectively. In the minimalist locking system of this invention, the single aperture in the female openings 350A–C replaces the two apertures, namely primary female openings 128A–C and secondary female openings 130A–C of the prior art carton shown in FIG. 1.

The minimalist can wrap of this embodiment of the invention is formed from the blank of FIG. 2 by moving the top panel 218 of the blank over a group of cans C.

Bottom flap 212 and 226 are folded upwardly against the bottoms of the cans and locked. Compression fingers on the wrap machine are inserted through the heel apertures 308 to tighten the carton for locking. It should be understood that bottom flap 226 is folded over bottom flap 212 and locked. The secondary male locks 322A–C are pushed inwardly and locked against secondary female locking ledges 340A–C. Primary male locks 316A–C are pushed inwardly and locked against primary female locking ledges 338A–C. Bottom flap 226 is on the outside of bottom flap 212.

As part of the process, tuck-in flaps 230, 242, 264 and 274 are folded inwardly as side panels 214 and 222 are moved downwardly around the group of cans C so that the tuck-in flaps are held against the inside of side panels 214 and 222 by the adjoining cans C. This pulls retaining flaps 234, 246, 252, 258, 268, 278, 284 and 290 tightly against the tops and bottoms respectively of each adjacent can to the retaining flaps preventing the cans C from falling out of the can wrap. Fingers on the wrap machine push in the tuck-in flaps 230, 242, 264, and 274. The stress relieving apertures 240A–H facilitate moving these tuck-in flaps and retaining flaps inwardly. Side panels 214 and 222 are pushed downwardly and inwardly and female locking panel 334 is pushed upwardly against the bottoms of the cans. Compression fingers can be inserted through the heel apertures 308 to tighten the wrap.

Bottom flap 212 and 226 are folded upwardly against the bottoms of the cans and locked. Compression fingers on the wrap machine are inserted through the heel apertures 308 to tighten the carrier for locking. It should be understood that bottom flap 226 is folded over bottom flap 212 and locked. The secondary male locks 322A–C are pushed inwardly and locked against secondary female locking ledges 340A–C. Primary male locks 316A–C are pushed inwardly and locked against primary female locking ledges 338A–C. Bottom flap 226 is on the outside of bottom flap 212.

SIGNIFICANT DIFFERENCES BETWEEN THE PRIOR ART CAN WRAP AND THE MINIMALIST CAN WRAP OF THIS INVENTION

Both of these can wraps are designed to contain six 354 milliliters cans, with each can having a diameter of 66 millimeters. The significant differences are pointed out below in respect to the can wraps made from the blank of FIG. 1 and the minimalist can wrap made from the blank of FIG. 2 apply equally to can wraps for containing cans of other sizes as well.

Since both the prior art can wrap and the minimalist can wrap are designed to contain six 354 millimeters can, a striking visual difference can be seen by comparing FIGS. 3–6.

Since the can C has a diameter of 66 millimeters, three cans C aligned in a row have a total diameter of 198 millimeters. One striking visual difference between the two can wraps is in the width of the blank. This visual difference is readily apparent in comparing the width of the view of the bottom of the wrap in FIG. 4 with the bottom of the wrap shown in FIG. 5. The blank of FIG. 1 has a width W of 198 millimeters which is exactly the width of three cans C in a row. It is logical to conclude that the width of the blank and wraps formed from it cannot be less than the width of the cans in a row without the cans falling out of the open ends of the wrap. Thus, it is quite surprising that the width W' of the minimalist can wrap made from the blank of FIG. 2 is 188 millimeters, which is about five percent less than the width W of the prior art can wrap made from the blank shown in FIG. 1.

The length L of the prior art blank shown in FIG. 1 is 539 millimeters, while the length L' of the blank shown in FIG. 2 for the minimalist can wrap is 525.75 millimeters, which is nearly 2.5 percent less than the length L of the prior art blank shown in FIG. 1. These differences between the width and length of the prior art blank and the minimalist blank result in significant savings of paperboard producing a more economical can wrap. It is surprising that a wrap can be made to wrap an identical group of cans with such a large reduction in the length and width of the can wrap.

It is important to realize how these differences between the length and width of the prior art blank and the minimalist blank of this invention are achieved. They cannot be achieved by simply reducing the width W and length L of the prior art blank shown in FIG. 1. If this were done, the cans C would simply roll out the ends of the can wrap due to reducing the width. Reducing the length would not provide sufficient space to lock the locks. The length of the prior art blank shown in FIG. 1 is reduced primarily by two important improvements in the locking system. In place of having primary female openings 128A–C and secondary female openings 130A–C of the prior art blank shown in FIG.1, the minimalist can wrap blank of FIG. 2 has a single female opening 350A–C for both the primary male locks 316A–C and secondary male locks 322A–C. The single female opening 350A–C replaces two apertures, namely primary female openings 128A–C and secondary openings 130A–C of prior art carton shown in FIG. 1. In other words, female openings 350A–C in the minimalist blank shown in FIG. 2 serve the function of locking both the primary male locks 316A–C and the secondary male locks 322A–C. The primary male locks 316A–C lock over primary female locking ledges 338A–C while the secondary male lock 322A–C locks over the secondary locking ledges 340A–C which also serves as cut lines on both sides of the female openings 350A–C to allow the secondary male locks 322A–C to enter the female locking panel 334.

In addition, the length S of the secondary male locks 122A–C of the prior art has been reduced from a length of 13.5 millimeters to a length S' of 11 millimeters in secondary male locks 322A–C of the minimalist can wrap is shown in FIG. 2. This has been achieved by refinement in the machine locking mechanism due to the fact that there is a single aperture in the female opening 350A–C for both the primary male locks 316A–C and secondary male locks 322A–C.

Figure 4:
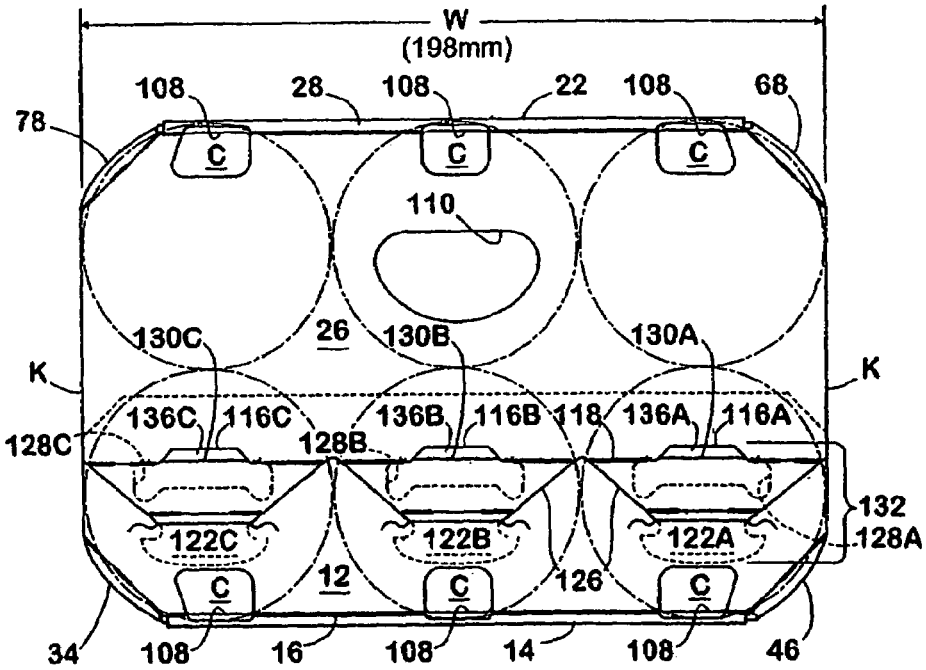
Prior Art FIG 4
FIG. 4 is a view of the bottom of the six can wrap of the prior art made from the blank of FIG. 1 and filled with cans.
Figure 5:
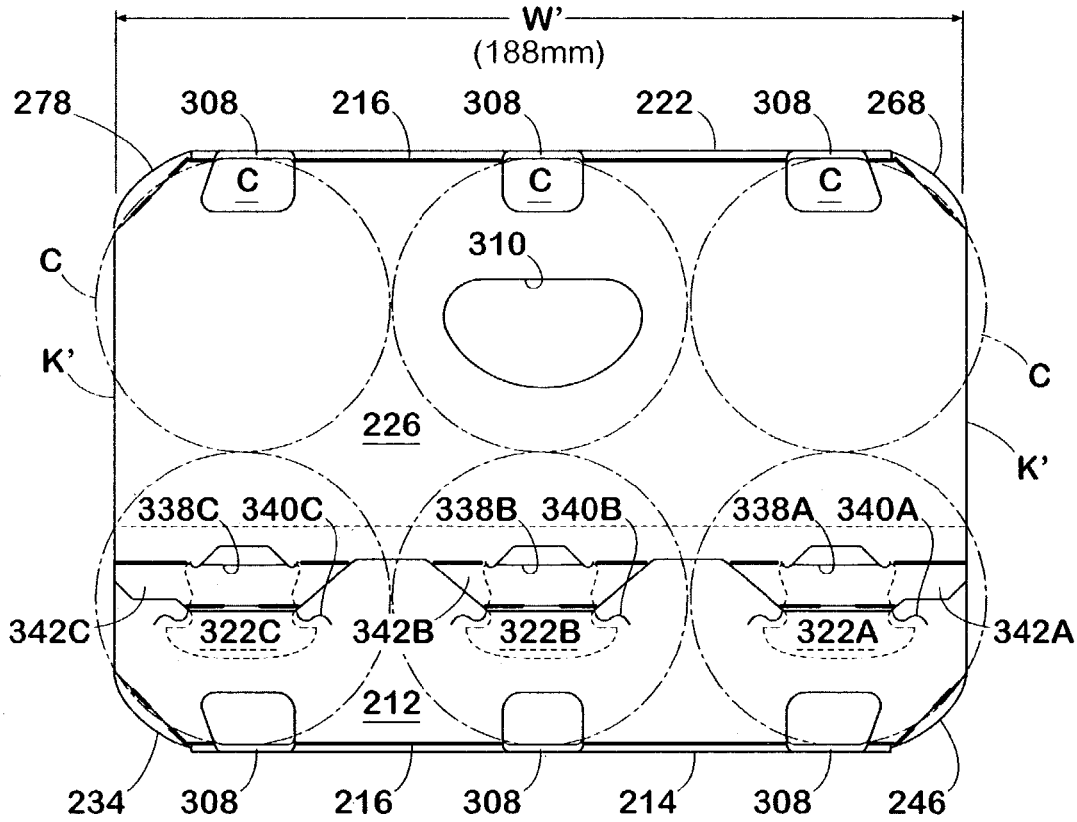
FIG. 5 is a view of the bottom of the minimalist six can wrap made from the blank of FIG. 2 and filled with cans.

Both FIG. 4 and FIG. 5 are drawn to scale. It will be readily apparent that the length V of the locking base 136A–C in the can wrap made from the prior art blank of FIG. 1 is greater than length V' of the locking base 336A–C of the minimalist can wrap made from the blank of FIG. 2. The length V of the locking base 136A–C of the prior art can wrap made from the blank of FIG. 1 is 12.5 millimeters while the length V' of the locking base 336A–C of the minimalist can wrap made from the blank of FIG. 2 is 10 millimeters, resulting in a 20 percent reduction in length of the base.

An important feature that permits reducing the length from V to V' in the minimalist carton blank is the presence of locking shoulders 342A&C on the base 336A&C of the outside secondary male locks 322A&C shown in FIG. 2. This locking shoulder is important in securing the locking system of the minimalist carton shown in FIG. 2. This reduction in the locking base 336A–C compared to 136A–C and the secondary male locks 322A–C compared to secondary male locks 122A–C, plus the reduction in the length P of the bottom flap 12 of the can wrap made from the blank of FIG. 1 to the length P' of the bottom flap 12 of the minimalist can wrap made from the blank of FIG. 2 results in reduction in the length L' of 539 millimeters in FIG. 1 versus a length L' of 525.75 millimeters in the minimalist blank illustrated in FIG. 2.

An important contribution to the reduction of the length of the minimalist can wrap is the reduction in the length of the bottom flap 12 of the carton. The length P of the bottom flap 12 is 56 millimeters as shown in FIG. 1, but has been reduced to a length P' of 47.75 millimeters in the minimalist blank of FIG. 2, which is a reduction of about 15 percent. This reduction is due in part to the use of a single female opening 350A–C in the minimalist wrap-around carrier rather than the use of a secondary female opening 130A and a primary female opening 128A required in the prior art carrier shown in FIG. 1.

Figure 6:
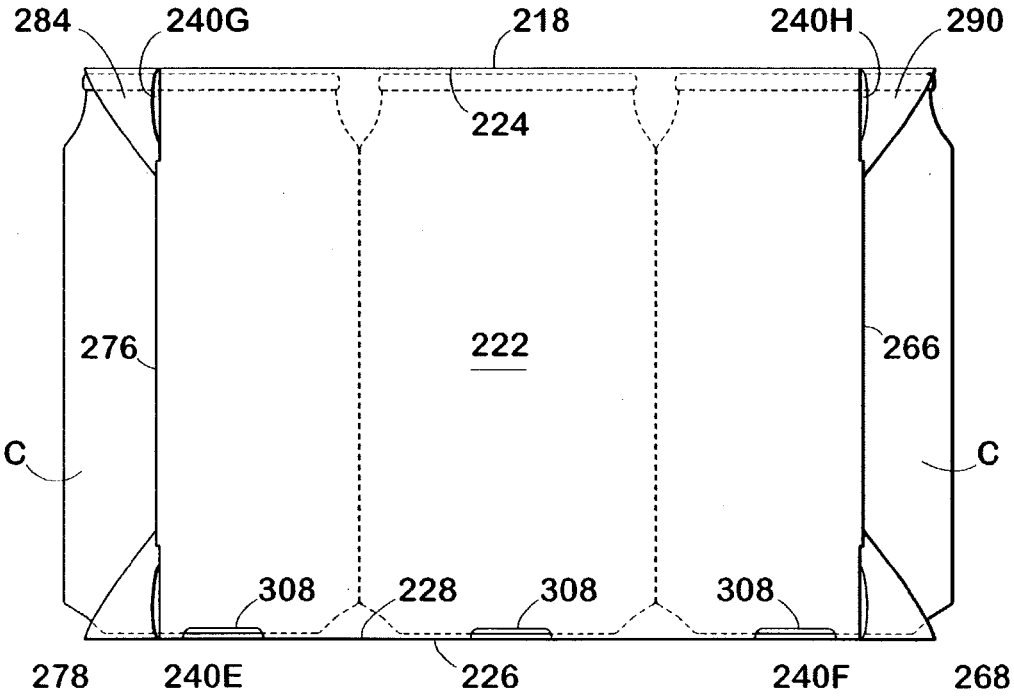
FIG. 6 is a side elevation view of the minimalist six can wrap made from the blank of FIG. 2 and filled with cans.

The significant reductions in the width W in FIG. 1 to W' in FIG. 2 would not be sufficient to retain the cans C in the wrap without the presence of tuck-in flaps and retaining flaps. The width W of FIG. 1 could not be reduced to less than the width of three cans unless some means of retaining the cans from falling out the open ends of the can wrap could be developed. One would expect that the width O of the tuck-in flap 30 could not be reduced without the cans falling out. However, it has been found that the width O of tuck-in flap 30 can be reduced from 22 millimeters to a width O' in tuck-in flap 230 of 17 millimeters, which is a percentage reduction of about 23 percent of the width O of tuck-in flap 30. Since there is a corresponding reduction in the width O' of tuck-in flap 242, this combination results in approximately five percent reduction in the width W (i.e. 198 millimeters) of the prior art blank illustrated in FIG. 1 to the width W' (i.e. 188 millimeters) of minimalist blank illustrated in FIG. 2. The width of the can wrap has been reduced by allowing the containers to project beyond each end of side panels of the carrier with the retaining flaps being designed so that they securely hold a portion of the top or bottom of each end of the container that extends beyond the end of the carrier. The retaining flaps 234, 246, 252, 258, 268, 278, 284, and 290 form an arc around an adjacent portion of the container that projects beyond the end of the side panels. The extent to which the cans project beyond the ends of the carrier is illustrated in FIG. 6. It is surprising that these retaining flaps are able to hold the cans in the minimalist wrap-around carrier illustrated in FIG. 6 when they project so far beyond the ends of the side panels the carrier (i.e. a total of 10 millimeters). These retaining flaps in the minimalist carrier are able to hold the cans in the wrap-around carrier because they are foldably attached (e.g. fold line 260) to a top panel or bottom flap that extends beyond the ends of the side panels of the carrier. This permits the retaining flap (e.g. 334) to extend diagonally across the side of the can from either the top end or bottom end of the can to the side panel. The design of these retaining flaps and the tightening of the wrap-around carrier which exerts pressure on the tuck-in panels results in the minimalist carrier holding the cans securely in position despite the fact that they project a sufficient distance beyond the ends of the side panels of the wrap-around carrier. It will be noticed that the retaining flap (e.g. 234) extends from the point on a can where it meets the end of a side panel to either the top or bottom end of the can which is a significant distance beyond the adjacent side panel. The retaining flap need not extend more than one-fourth of the circumference of the can C to hold it in the carrier.

The reductions in the length and width of the minimalist can wrap results in a sufficient savings of paperboard, but yet results in a can wrap which securely holds the containers in place due to the new features discussed above.

While the invention has been disclosed in its preferred forms, it will be apparent to those skilled in the art that many modifications, additions, and deletions can be made therein without departing from the spirit and scope of the invention and its equivalents as set forth in the following claims.

What is claimed is:

1. A locked wrap-around carrier having a length around the carrier and width with open ends containing a plurality of cylindrical containers each with a diameter in two rows comprising:

a. a top panel which is foldably interconnected to two side panels, one side panel being foldably connected to a first bottom flap and the other side said panel being foldably interconnected to a second bottom flap;

b. said first bottom flap having a plurality of primary male locks formed by slit cuts interconnected by fold lines in said first bottom flap, and having a plurality of locking bases formed as an extension of said flap with a secondary male lock formed as an extension of each locking base, with the locking base adjacent each end of the carrier having a locking shoulder extending from said adjacent locking base to the adjacent end of the carrier to aid in securing said locks in the locked position;

c. said second bottom flap having a plurality of female openings, with each such opening having a primary female locking ledge against which a primary male lock is secured and having a secondary female locking ledge against which a secondary male lock is secured;

d. said carrier having a tuck-in flap foldably attached to each side panel at each end of the carrier with each flap having a top and bottom with a retaining flap foldably attached to the top of each tuck-in flap and foldably attached to the top panel, and a retaining flap foldably attached to the bottom of each tuck-in flap and an adjacent bottom flap; and e. with the width of the side panels of the carrier being significantly less than the sum of the diameters of the containers in each row with all of said containers on each end of the carrier extending a significant distance beyond the adjacent side panel, said containers being prevented from falling out of the carrier by each tuck-in flap being wedged between an adjacent container and an adjacent side panel so as to hold the retaining flap on each end of the tuck-in panel securely against an adjacent can, each said retaining flap extending from an end of said container in a diagonal arc across a portion of the side of said container that projects beyond said end of said adjacent side panel of the carrier to an adjacent side panel.

2. The carrier of claim 1 in which there is an aperture between each retaining flap and the adjacent side panel to facilitate folding, and holding said retaining flap in a diagonal arc position across a portion of the side of said adjacent container.

3. The carrier of claim 1 in which the length of each locking base and each attached secondary locking male lock is significantly less than the length of the locking base and attached secondary male lock that extends from the end of a bottom flap of a carrier with a conventional secondary male lock due to the presence of locking shoulders between the locking base adjacent each end of the carrier and the end of the carrier which aids in holding all of the locks securely locked and the use of a single female opening for locking both a primary and secondary male lock thereby reducing the length of the carrier.

4. The carrier of claim 1 in which at least one locking base of the locking bases is, when considered alone, asymmetrical at least because of the locking shoulder of the at least one locking base.

5. The carrier of claim 4 in which there is at least one gap between at least one pair of adjacent locking bases of the plurality of locking bases.

6. The carrier of claim 4 in which the locking shoulder of the at least one locking base includes:

a first edge that extends parallel to the width of the side panels, and a second edge that extends perpendicular to the width of the side panels.

7. The carrier of claim 6 in which the locking shoulder of the at least one locking base further includes an third edge that extends diagonally from the first edge to the second edge.

8. The carrier of claim 7 in which there is at least one gap between at least one pair of adjacent locking bases of the plurality of locking bases.

9. The carrier of claim 1 in which at least one locking shoulder of the locking shoulders includes:

a first edge that extends parallel to the width of the side panels, and a second edge that extends perpendicular to the width of the side panels.

10. The carrier of claim 9 in which the at least one locking shoulder further includes a third edge that extends diagonally from the first edge to the second edge.

11. The carrier of claim 2 in which at least one locking base of the locking bases is, when considered alone, asymmetrical at least because of the locking shoulder of the at least one locking base.

12. The carrier of claim 2 in which at least one locking shoulder of the locking shoulders includes:

a first edge that extends parallel to the width of the side panels, a second edge that extends perpendicular to the width of the side panels, and a third edge that extends diagonally from the first edge to the second edge.

13. The carrier of claim 3 in which at least one locking base of the locking bases is, when considered alone, asymmetrical at least because of the locking shoulder of the at least one locking base.

14. The carrier of claim 3 in which at least one locking shoulder of the locking shoulders includes:

a first edge that extends parallel to the width of the side panels, a second edge that extends perpendicular to the width of the side panels, and a third edge that extends diagonally from the first edge to the second edge.

15. In a locked wrap-around carrier having a length around the carrier and width with open ends containing a plurality of cylindrical containers each with a diameter in two rows which has a top panel and two interconnected side panels each being foldably connected to a bottom flap, said carrier being locked by a plurality of primary male locks formed in a bottom flap and secondary male locks formed as an extension of a locking base extending from the end of said bottom flap in which the said primary locks are formed and a plurality of single female apertures in the other bottom flap, through each of which a primary male lock and secondary male lock are secured, said carrier having a tuck-in flap attached to each side panel with a top and bottom with a retaining flap attached to the top of each tuck-in flap and the top panel and a retaining flap attached to bottom of each tuck-in flap and an adjacent bottom flap, with each tuck-in flap being wedged between an adjacent side panel and adjacent container, with each retaining flap holding a portion of an adjacent container in the carrier, wherein the improvement is that the length of the carrier has been significantly reduced by providing a locking shoulder on the locking base adjacent each end of the carrier between the locking base and the adjacent end of the carrier which aids in securing the locking of the secondary locks while permitting the length of each locking base between the attached secondary male lock and the bottom flap to which the base is attached to be significantly reduced resulting in a significant reduction in the length of the carrier.

16. The carrier of claim 15 which has a further improvement in which the width of the side panels of the carrier has been significantly reduced to a width less than the sum of the diameters of the containers in each row so that the containers on each end of the carrier project a significant distance beyond the end of said side panels of the carrier, said additional improvement being achieved by constructing each retaining flap so that it extends in a diagonal arc across a portion of the adjacent container that projects beyond the end of a side panel of the carrier, so that the combination of all of the retaining flaps on the carrier, each of which is held in place by a tuck-panel wedged between a side panel and an adjacent container, securely holds all of the containers together in the carrier.

17. The carrier of claim 15 in which at least one locking base of the locking bases is, when considered alone, asymmetrical at least because of the locking shoulder of the at least one locking base.

18. The carrier of claim 17 in which there is at least one gap between at least one pair of adjacent locking bases of the plurality of locking bases.

19. The carrier of claim 17 in which the locking shoulder of the at least one locking base includes:

a first edge that extends parallel to the length of the carrier, and a second edge that extends perpendicular to the length of the carrier.

20. The carrier of claim 19 in which the locking shoulder of the at least one locking base further includes an third edge that extends diagonally from the first edge to the second edge.

21. The carrier of claim 20 in which there is at least one gap between at least one pair of adjacent locking bases of the plurality of locking bases.

22. The carrier of claim 15 in which at least one locking shoulder of the locking shoulders includes:

a first edge that extends parallel to the length of the carrier, and a second edge that extends perpendicular to the length of the carrier.

23. The carrier of claim 22 in which the at least one locking shoulder further includes a third edge that extends diagonally from the first edge to the second edge.

24. The carrier of claim 16 in which at least one locking base of the locking bases is, when considered alone, asymmetrical at least because of the locking shoulder of the at least one locking base.

* * * * *